United States Patent [19]

Overall et al.

[11] Patent Number: 4,522,309

[45] Date of Patent: Jun. 11, 1985

[54] CATHODE-RAY TUBE

[75] Inventors: Colin D. Overall, Reigate; Leslie H. Francis, Horley, both of England

[73] Assignee: U.S. Philips Corporation, New York, N.Y.

[21] Appl. No.: 559,589

[22] Filed: Dec. 8, 1983

[30] Foreign Application Priority Data

Jan. 7, 1983 [GB] United Kingdom ..... 8300351

[51] Int. Cl.[3] ..... H01J 29/86

[52] U.S. Cl. ..... 220/2.1 A; 220/2.1 R

[58] Field of Search ..... 220/2.1 A, 2.1 R, 2.3 A, 220/2.3 R, 80, 324, 326

[56] References Cited

U.S. PATENT DOCUMENTS

| | | | |
|---|---|---|---|
| 741,362 | 10/1903 | Ohnstrand | 220/80 X |
| 3,073,479 | 1/1963 | Broverman et al. | 220/326 X |
| 3,443,601 | 5/1969 | Siegwart | 220/80 X |
| 4,268,712 | 5/1981 | Overall | 220/2.3 A X |

*Primary Examiner*—Steven M. Pollard

*Attorney, Agent, or Firm*—Robert J. Kraus

[57] ABSTRACT

An envelope of a cathode-ray tube comprises a metal rear housing (1) and a glass face-plate (3) which is sealed in a vacuum-tight manner to a flange (2) on the rear housing by means of a seal (4) formed between the face-plate and the flange. To prevent the face-plate from peeling away from the seal and/or the seal from peeling away from the flange of the rear housing when the face-plate deflects inwards during evacuation of the envelope, spring clamps 5 are provided on the edges of the face-plate and flange, each clamp consisting of a spring-steel channel member with wall portions (9*a* and 9*b*) which converge towards the mouth of the channel member. The channel member, at parts (10*a* and 10*b*) thereof which bound or adjoin the converging wall portions where these portions are nearest one another, engage the front and rear surfaces (6 and 7) of the face-plate and the flange respectively to exert clamping forces on these surfaces in directions substantially perpendicular thereto. The clamps are especially suitable for envelopes in which the face-plate and the flange of the rear housing are of rectangular shape with straight edges.

6 Claims, 8 Drawing Figures

CATHODE-RAY TUBE

BACKGROUND OF THE INVENTION

The invention relates to a cathode-ray tube having an envelope comprising a metal rear housing and a glass face-plate which is sealed in a vacuum-tight manner to a flange on the rear housing by means of a seal formed between the face-plate and the flange. The seal may be a pressure-bonded seal consisting of a pressure-deformable material, or it may be formed by an adhesive which bonds the face-plate to the flange.

The rear housing, which contains the electron gun and other components of the cathode-ray tube, is usually referred to as the cone portion of the envelope, although it may not be strictly, or even remotely, conical in the geometric sense. For example, a new type of rear housing which is very relevant to the present invention and which may be referred to as a "flat-can" rear housing has the form of a shallow, rectangular, flat-bottomed metal can with an open top surrounded by a flange. An envelope having this type of rear housing is used in flat cathode-ray tubes. To form the envelope a rectangular glass face-plate is sealed to the flange of the can.

In the manufacture of a cathode-ray tube having an envelope of the construction described in the opening paragraph above, when the envelope is evacuated the face-plate deflects inwards slightly and there is a consequent tendency for the face-plate to peel away from the seal between the face-plate and the flange of the rear housing and/or for the seal to peel away from the flange. To counteract this tendency the Applicants have already proposed in their prior United Kingdom Patent Specification No. 1,598,888, which is concerned with a cathode-ray tube of the kind in which the edges of the face-plate and the edges of the flange of the rear housing have a slight convex curvature, to clamp the face-plate to the flange by means of channel members which are slightly curved to conform to the curvature of the edges of the face-plate and the flange and which are forced onto these edges by a metal rim-band which extends around the periphery of the face-plate and flange. The rim-band can be tightened by means of a draw-bolt or it may be an endless band shrunk onto the channel members. Either way the resulting longitudinal tensile stress in the band, due to the curvature of the channel members, produces a force on these members which drives them tightly onto the mating edges of the face-plate and the flange. One side wall of each of the substantially U-section channel members lies flat against the outer surface of the face-plate; the other side wall diverges slightly with respect to the first side wall so as to exert a wedging action on the flange which urges the flange towards the face-plate and constrains it to follow the deflection of the face-plate when the envelope is evacuated.

Since the rim-band operates by exerting on the channel members forces which are directed transversely of these members towards the inside of the envelope, the combination of rim-band and channel members can be used only on envelopes in which the edges of the face-plate and the flange of the rear housing have a convex curvature. In view of the trend towards flat cathode-ray tubes here is a growing need for a clamping means which can be used on envelopes in which the face-plate and the flange are of rectangular shape with straight edges. It is an object of the invention to satisfy this need.

SUMMARY OF THE INVENTION

According to the invention, a cathode-ray tube having an envelope comprising a metal rear housing and a glass face-plate which is sealed in a vacuum-tight manner to a flange on the rear housing by means of a seal formed between the face-plate and the flange, means being provided for clamping the face-plate and the flange so as to maintain the seal under compression, is characterised in that the clamping means comprise spring clamps in the form of channel members each having wall portions which converge towards the mouth of the channel member, each channel member, at parts thereof which bound or adjoin the converging wall portions of the channel member where these portions are nearest one another, engaging the outer surface of the face-plate and the surface of said flange which is remote from the face-plate to exert clamping forces on these surfaces in directions substantially perpendicular thereto.

The invention provides an extremely simple form of clamp which, since it can exert clamping forces which are directed wholly at right angles to the surfaces of the face-plate and of the flange of the rear housing, can be used both on envelopes in which the face-plate and the flange have straight edges and on envelopes in which the edges of the face-plate and flange have a convex curvature. Also, the forces exerted by the clamps in the present invention are wholly utilised in the clamping action. With the wedging action of the channel members described in the Applicant's earlier specification referred to above, only part of the forces exerted by these members acts to clamp the face-plate to the flange of the rear housing and keep the seal between the face-plate and the flange under compression; another part acts in directions parallel to the surfaces of the face-plate and the flange and therefore does not contribute to the clamping action. Another advantage of clamping forces which act wholly at right angles to the surfaces of the face-plate and the flange is that they are not affected by the slight relative movement which takes place between the face-plate and the flange in directions parallel to these surfaces when the face-plate deflects during evacuation of the envelope.

Since the clamps in the present invention apply pressure at right angles to the surfaces of the face-plate and the flange they can engage these surfaces at a distance from the edges of the face-plate and flange, unlike the channel members in the Applicants' earlier specification, which engage the flange at its edges. The clamps in the present invention need have no contact with the edges of the face-plate and flange, which has the considerable advantage that these edges require no finishing treatment. The glass face-plate can be simply diamond cut and arrised without the need for any grinding at the edges, which yields considerable savings in production costs. The rear housing can be punched from metal sheet and requires no finishing at the edges of the flange.

The clamps permit wider dimensional tolerances at the edges of the face-plate and the flange. They can also accommodate different thicknesses of the face-plate and flange and different thicknesses of the seal between the face-plate and the flange.

The straight channel members forming the clamps are very simple to make compared with the earlier curved channel members. Also, there is not the added cost of making and fitting a rim-band. To fit the clamps, which may be made of spring steel, it is merely necessary to force their converging wall portions apart with a suitable tool, mount the clamps over the relevant edge portions of the face-plate and the flange and then release the clamps to allow them to engage the surfaces of the face-plate and the flange.

Each of the channel members forming the clamps preferably has a constant cross-section throughout its length and the cross-section is preferably symmetrical with respect to a central longitudinal plane lying between and parallel to the converging wall portions of the channel member.

An embodiment of the invention having clamps which are particularly simple to make is characterised in that each channel member consists of a cylindrical tube with a gap in its wall which extends throughout the length of the tube to form converging wall portions on opposite sides of the gap, said wall portions being bounded by the edges of the wall of the tube which bound the gap, which edges engage said surfaces of the face-plate and the flange of the rear housing.

Another embodiment is characterised in that each channel member comprises flat wall portions which bound the converging wall portions where the latter portions are nearest one another and which engage said surfaces of the face-plate and the flange of the rear housing.

Yet another embodiment is characterised in that each channel member comprises curved wall portions which bound the converging wall portions where the latter portions are nearest one another and which have convexly curved inner surfaces which engage said surfaces of the face-plate and the flange of the rear housing.

Additional clamping pressure and/or a greater distribution of the clamping pressure can be obtained with an embodiment of the invention which is characterised by a first series of clamps accommodated within a second series of larger clamps so that the two series engage said surfaces of the face-plate and the flange of the rear housing at different distances from the edges of the face-plate and the flange.

Increased clamping pressure can also be obtained with an embodiment of the invention which is characterised by a first series of said spring clamps which engage said surfaces of the face-plate and the flange of the rear housing, and a further series of spring clamps in the form of channel members each having wall portions which converge towards the mouth of the channel member, each clamp of the further series embracing a clamp of the first series and acting on that clamp so as to exert through it clamping forces on said surfaces of the face-plate and flange.

BRIEF DESCRIPTION OF THE DRAWING

Some embodiments of the invention will now be described by way of example with reference to the accompanying drawing, in which.

DESCRIPTION OF THE PREFERRED EMBODIMENTS

Figure 1:
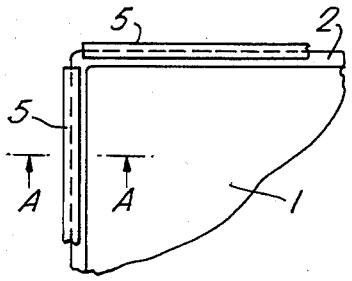
FIG. 1 is a diagrammatic rear view, drawn to a very much reduced scale, of part of an envelope for a cathode-ray tube according to the invention in which the face-plate and the flange of the rear housing of the envelope have a rectangular shape with straight edges.
Figure 3:
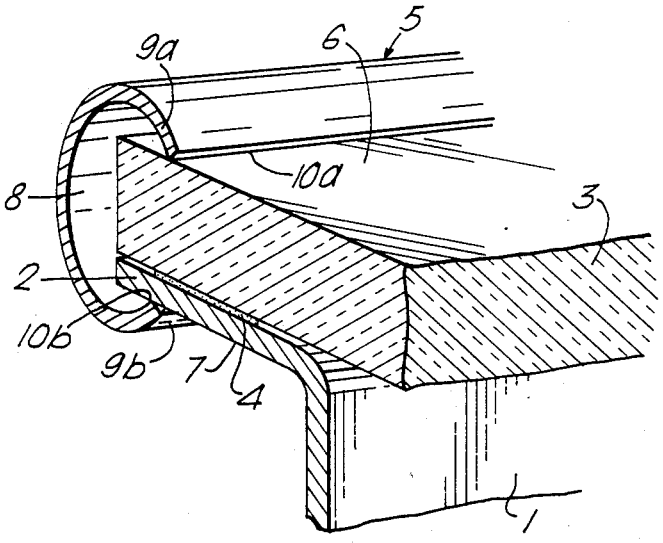
FIG. 3 is a sectional perspective view, drawn to an enlarged scale, of a portion of the envelope of FIG. 1, showing the face-plate clamped to the flange of the rear housing by a first embodiment of the clamping means of the tube according to the invention.

The envelope shown in FIG. 1 has a rectangular flat-can metal rear housing 1 with a flange 2 to which, as can be seen in FIG. 3, a glass face-plate 3 is sealed in a vacuum-tight manner by means of a pressure-bonded seal 4 consisting of a pressure-deformable material, for example, lead. The pressure-bonding of the seal 4 may be carried out by thermocompression, for example, by a method similar to that described in the Applicants' aforesaid prior United Kingdom Specification No. 1,598,888. When the bonding has been completed, spring clamps 5 are fitted over the flange 2 and edge portions of the face-plate 3 to clamp the face-plate to the flange. When the envelope is subsequently evacuated and the face-plate consequently deflects inwards slightly, the clamps 5 constrain the flange 2 to follow the deflection of the face-plate, thereby preventing the face-plate from peeling away from the seal 4 and/or the seal from peeling away from the flange 2.

Either one long clamp, as in FIG. 1, or a number of short clamps may be provided along each edge of the face-plate and flange. Each clamp consists of a channel member having wall portions which converge towards the mouth of the channel member. Each channel member, at parts thereof which bound or adjoin the converging wall portions where these portions are nearest one another, engages the front, outer surface 6 (FIG. 3) of the face-plate 3 and the rear surface 7 of the flange 2 to exert clamping forces on these surfaces in directions substantially perpendicular thereto. The seal 4 between the face-plate and the flange is kept under compression by these forces. Each channel member has a constant cross-section throughout its length and the cross-section is preferably symmetrical with respect to a central longitudinal plane lying between and parallel to the converging wall portions of the channel member. The cross-section may have any of a variety of shapes.

FIG. 3 shows a particularly simple form of channel member consisting of a cylindrical tube 8 with a gap in its wall which extends throughout the length of the tube to form converging wall portions 9*a* and 9*b* on opposite sides of the gap. To fit the clamp it is merely necessary to force the longitudinal edges 10*a* and 10*b* of this channel member apart with the aid of a suitable tool until the distance between these edges is greater than the distance between the surfaces 6 and 7 of the face-plate 3 and flange 2. Notches or holes (not shown) could readily be provided in the wall portions 9*a* and 9*b* of the channel member to enable a C-spanner to be used for this purpose. The channel member is then mounted over the respective edge portions of the flange 2 and face-plate 3, and the longitudinal edges 10*a* and 10*b* of the channel member, which edges bound the converging wall portions 9*a* and 9*b* where these portions are nearest one another, are allowed to engage the surfaces 6 and 7 of the face-plate and the flange.

Figure 4:
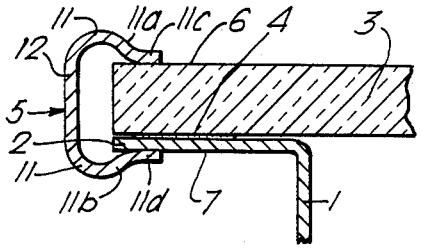
FIGS. 4 to 8 are sectional views of portions of envelopes similar to the envelope of FIG. 1, taken on lines corresponding to the line A—A in FIG. 1 and showing the face-plates clamped to the flanges of the rear housings by further embodiments of the clamping means of the tube according to the invention.

The clamp 5 shown in FIG. 4 consists of a channel member having two side walls 11 which curve outwardly from a flat bottom wall 12 and then inwardly to form converging wall portions 11*a* and 11*b*. Adjoining these converging portions are flat portions 11*c* and 11*d* of the side walls 11, which portions engage the surfaces 6 and 7 of the face-plate 3 and flange 2 to exert the desired clamping forces thereon.

Figure 5:
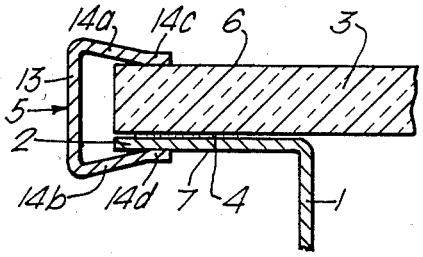

In the embodiment shown in FIG. 5 the channel member has a flat bottom wall 13 and two side walls which comprise flat converging portions 14*a* and 14*b* which extend from the bottom wall 13 and further flat portions 14*c* and 14*d* which adjoin the converging portions 14*a* and 14*b* and which engage the surfaces 6 and 7 of the face-plate 3 and flange 2.

Figure 6:
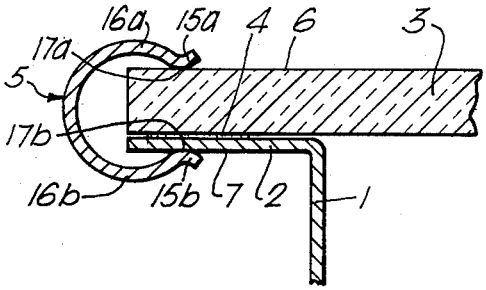

FIG. 6 shows a clamp 5 which is similar to the clamp shown in FIG. 3 except that the channel member forming the clamp in FIG. 6 has edge portions 15*a* and 15*b* which adjoin and curve outwardly from the converging wall portions, designated 16*a* and 16*b* in this embodiment, to form convexly curved inner surfaces 17*a* and 17*b* on the channel member for engaging the surfaces 6 and 7 of the face-plate and flange.

Figure 7:
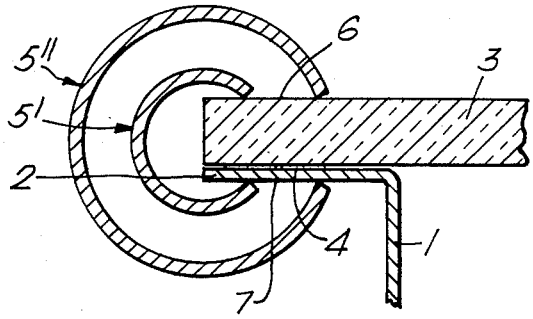

If additional clamping pressure is required a further series of clamps can be provided, as shown by way of example in FIG. 7. This Figure shows how a first series of clamps 5' can be accommodated within a second series of larger clamps 5'' so that the two series engage the surfaces 6 and 7 of the face-plate 3 and flange 2 at different distances from the edges of the face-plate and the flange. In the embodiment shown the clamps of each series consist of channel members of the form shown in FIG. 3 but obviously this is not essential; in fact, the clamps of one series may consist of channel members having a different cross-sectional shape from that of the channel members forming the clamps of the other series.

Figure 8:
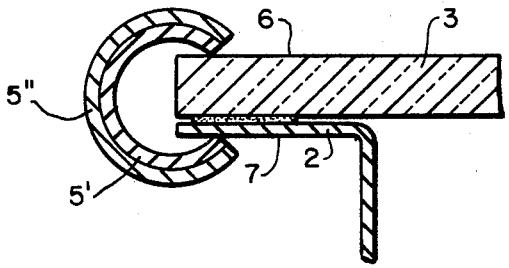

This arrangement of two series of clamps also provides a greater distribution of the clamping pressure transversely of the flange 2. If an increased pressure without increased distribution is required, a second series of clamps 5 can be arranged on a first series 5' (see FIG. 8) and the latter series arranged in engagement with the surfaces 6 and 7 of the face-plate 3 and flange 2. In this arrangement each clamp 5 of the second series embraces a clamp 5' of the first series and exerts thereon a clamping pressure which is transmitted by the inner clamp to the surfaces 6 and 7. Preferably, the clamps of the two series consist of channel members of similar cross-sectional shape so that each clamp of the inner series nests within a clamp of the outer series.

The drawings show a few examples of suitable cross-sectional shapes for the channel members which form the clamp. Obviously, the invention is not limited to these examples; many other cross-sectional shapes may be employed within the scope of the invention as defined in the subsequent claims herein.

The clamps may be made of spring steel. Stainless steel or another suitable metal having hot-strength should be used if the envelope is subsequently to be subjected to a high temperature, for example, during the baking cycle of the cathode-ray tube. This may also require the use of another metal, for example, copper or gold, instead of lead for the seal 4.

Figure 2:
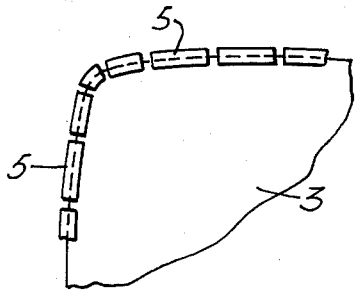
FIG. 2 is a diagrammatic front view, again drawn to a very much reduced scale, of part of an envelope for a cathode-ray tube according to the invention, in which the edges of the face-plate and the edges of the flange of the rear housing have a slight convex curvature.

FIG. 2 illustrates the application of the invention to a cathode-ray tube having an envelope with a flanged metal rear housing of more conventional form, such as the envelope illustrated in the aforesaid prior specification No. 1,598,888, in which the edges of the flange of the rear housing and the edges of the face-plate have a slight convex curvature. On such an envelope, a number of short clamps 5 can be fitted on each edge of the face-plate and flange, each clamp consisting of a channel member which may have any of the forms described above.

We claim:

1. A cathode ray tube envelope comprising a metal rear housing having a flange, a glass faceplate secured to the flange to close the envelope, a pressure-bonded seal disposed between the faceplate and the flange, and means for clamping the faceplate to the flange, said clamping means comprising a plurality of resilient channel-shaped spring clamps arranged around the faceplate-flange periphery, each spring clamp having converging side walls which, at the portions nearest each other, engage respective outer surfaces of the faceplate and the flange, thereby maintaining compression of said seal.

2. A cathode ray tube envelope as in claim 1 where at least one of said spring clamps comprises a cylindrical tube having a longitudinal gap in one side thereof extending throughout the length of the tube.

3. A cathode ray tube envelope as in claim 1 where said nearest portions of at least one of said spring clamps are flat where the portions engage said outer surfaces.

4. A cathode ray tube envelope as in claim 1 where said nearest portions of at least one of said spring clamps are curved where said portions engage said outer surfaces.

5. A cathode ray tube as in claim 1, 2, 3 or 4 where said clamping means comprises a first one of said spring clamps disposed within a second one of said spring clamps, said first and second spring clamps independently engaging said respective outer surfaces.

6. A cathode ray tube envelope as in claim 1, 2, 3 or 4 where said clamping means comprises a first one of said spring clamps disposed within a second one of said spring clamps, said first spring clamp engaging said outer surfaces to directly apply clamping pressure to said outer surfaces, and said second spring clamp engaging said first spring clamp to indirectly apply clamping pressure to said outer surfaces.

* * * * *